US008530127B2

(12) United States Patent
Jang et al.

(10) Patent No.: US 8,530,127 B2
(45) Date of Patent: Sep. 10, 2013

(54) PROCESS FOR PREPARING POLYMERIZED TONER

(75) Inventors: Wook Jang, Daejeon (KR); Chang-Soon Lee, Daejeon (KR)

(73) Assignee: LG Chem, Ltd., Seoul (KR)

( * ) Notice: Subject to any disclaimer, the term of this patent is extended or adjusted under 35 U.S.C. 154(b) by 330 days.

(21) Appl. No.: 12/842,658

(22) Filed: Jul. 23, 2010

(65) Prior Publication Data

US 2011/0020742 A1 Jan. 27, 2011

(30) Foreign Application Priority Data

Jul. 24, 2009 (KR) ..... 10-2009-0068051

(51) Int. Cl.
*G03G 9/097* (2006.01)

(52) U.S. Cl.
USPC ..... 430/108.5; 430/108.1; 430/137.15

(58) Field of Classification Search
USPC ..... 430/137.15, 108.5, 108.1
See application file for complete search history.

(56) References Cited

U.S. PATENT DOCUMENTS

| | | | | |
|---|---|---|---|---|
| 6,342,328 | B1 * | 1/2002 | Takasaki et al. | 430/108.22 |
| 6,569,589 | B2 * | 5/2003 | Inaba et al. | 430/108.22 |
| 2009/0170019 | A1 * | 7/2009 | Kuramoto et al. | 430/108.22 |

FOREIGN PATENT DOCUMENTS

| | | | |
|---|---|---|---|
| CN | 1904744 | A | 1/2007 |
| CN | 1942830 | A | 4/2007 |
| JP | 2005275243 | A * | 10/2005 |
| KR | 10-2008-0049391 | A | 6/2008 |
| WO | 2009/054624 | A2 | 4/2009 |

OTHER PUBLICATIONS

Machine Translation of JP 2005275243 A.*

* cited by examiner

*Primary Examiner* — Jonathan Jelsma

(74) *Attorney, Agent, or Firm* — Rothwell, Figg, Ernst & Manbeck, P.C.

(57) ABSTRACT

A process for preparing toner and a polymerized toner prepared thereby are provided. The process for preparing toner comprises: forming an aqueous dispersion medium comprising calcium phosphate; forming a monomer mixture of a polymer charge control agent having weight average molecular weight of about 10,000 to 20,000, pigment, and a monomer for a binder resin; dispersing the monomer mixture in the aqueous dispersion in the form of droplets; and suspension-polymerizing the monomer mixture dispersed in the form of droplets, wherein about 2 to 6 parts by weight of the calcium phosphate and about 0.6 to 10 parts by weight of the charge control agent are used, on the basis of 100 parts by weight of the monomer mixture.

17 Claims, No Drawings

PROCESS FOR PREPARING POLYMERIZED TONER

CROSS REFERENCE TO RELATED APPLICATION

The present application claims priority to and the benefit of Korean patent application No. 2009-0068051 filed in the Korea Intellectual Property Office on Jul. 24, 2009, the entire content of which is incorporated hereinto by reference.

BACKGROUND OF THE INVENTION (a) Field of the Invention

The present invention relates to a process for preparing polymerized toner, specifically to a process for preparing polymerized toner that can realize narrow particle size distribution, high transcription efficiency and uniform image by using calcium phosphate as an aqueous dispersion stabilizer and a polymer charge control agent having a specific molecular weight range during suspension polymerization.

(b) Description of the Related Art

Toner refers to paint that is used for development of electronic photos and an electrostatic printer, a copier, etc., and can be transcribed and adhered to a transcription material to form a desired pattern. Recently, as preparation of a document using a computer has been generalized, demand for an image formation device such as a printer is rapidly increasing, and thus, toner use amount is also increased.

In general, a process for preparing toner includes a process using pulverization and a process using polymerization. The process using pulverization, which is most widely known, simultaneously introduces resin and pigment through a melting-mixing process, and after melting-mixing or extrusion, pulverizes and distributes to prepare toner particles. However, toner particles prepared by this process have wide particle size distribution, and have very irregular shape such as sharp edge, etc., and thus chargeabilty or flowability is not good.

To solve this problem, a process for preparing spherical toner particles by polymerization has been suggested. As the process for preparing toner by polymerization, emulsion polymerization (aggregation process) and suspension polymerization are known, and the emulsion polymerization is difficult to control particle size distribution and has a problem of reproducibility of prepared toner quality, and thus, a process for preparing toner by suspension polymerization is more favored.

However, the process by suspension polymerization involves a process of dispersing a monomer mixture in the form of droplets through homogenization with an aqueous dispersion and polymerizing, during which process, it is difficult to prepare particles having narrow particle size distribution. And, the toner particles produced by the suspension polymerization should have very uniform chargeability so as to realize high transcription efficiency and uniform image.

SUMMARY OF THE INVENTION

The present invention provides a process for preparing polymerized toner that can realize narrow particle size distribution, high transcription efficiency and uniform image.

According to one aspect of the invention, a process for preparing toner comprising: forming an aqueous dispersion medium comprising calcium phosphate; forming a monomer mixture of a polymer charge control agent having weight average molecular weight of 10,000 to 20,000, pigment, and a monomer for a binder resin; dispersing the monomer mixture into the aqueous dispersion medium in the form of droplets; and suspension-polymerizing the monomer mixture dispersed in the form of droplets, wherein about 2 to 6 parts by weight of the calcium phosphate and about 0.6 to 10 parts by weight of the charge control agent are used, based on 100 parts by weight of the monomer mixture, is provided.

The calcium phosphate may be prepared by mixing an aqueous phosphate solution and an aqueous solution of calcium salt, which may further comprise dropping water-soluble inorganic acid to the aqueous phosphate solution and adding the aqueous solution of calcium salt thereto, so as to control pH of the aqueous dispersion medium in the range of about 4 to 7.

The charge control agent may be styrene acrylic polymer comprising sulfonic acid group.

The dispersing of the monomer mixture into the aqueous dispersion medium in the form of droplets may comprise mixing the monomer mixture and the aqueous dispersion medium, and homogenizing the mixture with a homogenizer at a speed of about 5,000 rpm to 20,000 rpm.

After the suspension polymerization, the process may further comprise washing the produced toner particles to remove calcium phosphate, and drying the toner particles. For this case, before conducting the washing, the process may further comprise dropping water-soluble inorganic acid to the resultant solution of the suspension polymerization so as to control pH of the solution to about 2.0 or less.

The monomer for a binder resin may be at least one selected from the group consisting of an aromatic vinyl based monomer, an acrylic monomer, a methacrylic monomer, and a diene based monomer.

The pigment may be at least one selected from the group consisting of metal powder pigment, metal oxide pigment, carbon pigment, sulfide pigment, chrome pigment, ferrocyanide pigment, azo-type pigment, acid dye pigment, basic dye pigment, mordant dye pigment, phthalocynine pigment, quinacridone pigment, and dioxane pigment.

The monomer mixture may further comprise at least one additive selected from the group consisting of wax, a reaction initiator, a crosslinking agent, a lubricant, a molecular weight control agent, and a coupling agent.

The wax may be at least one selected from the group consisting of paraffin wax, microcrystalline wax, ceresin wax, carnauba wax, ester type wax, polyethylene type wax and polypropylene type wax.

The reaction initiator may be at least one selected from the group consisting of azobisisobutyronitrile, azobisvaleronitrile, benzoyl peroxide, lauroyl peroxide, potassium persulfate, and ammonium persulfate.

The crosslinking agent may be at least one selected from the group consisting of divinylbenzene, ethylene dimethacrylate, ethylene glycol dimethacrylate, diethylene gylcol diacrylate, 1,6-hexamethylene diacrylate, allyl methacrylate, 1,1,1-trimethylolpropane triacrylate, triallylamine and tetra allyl oxyethane.

The molecular weight control agent may be at least one selected from the group consisting of t-dodecyl mercaptan, n-dodecyl mercaptan, n-octyl mercaptan, carbon tetrachloride and carbon tetrabromide.

Another aspect of the present invention provides polymerized toner prepared by the above process.

The polymerized toner may comprise about 0.8 to 30 parts by weight of the polymer charge control agent having weight average molecular weight of about 10,000 to 20,000, and about 2 to 28 parts by weight, preferably about 3 to 25 parts by weight of the pigment, based on 100 parts by weight of the monomer for a binder resin.

The polymerized toner may further comprise, based on 100 parts by weight of the monomer for a binder resin, at least one selected from the group consisting of about 0.3 to 35 parts by weight of wax, about 0.03 to 10 parts by weight of a reaction initiator, about 0.003 to 15 parts by weight of a crosslinking agent, and about 0.003 to 12 parts by weight of a molecular weight control agent.

DETAILED DESCRIPTION OF THE EMBODIMENTS

A process for preparing polymerized toner according to concrete embodiment of the invention will be described.

The present inventors found that dispersion stability and suspension polymerization stability can be secured, particle size can be easily controlled and narrow particle size distribution can be achieved by using calcium phosphate as an aqueous dispersion stabilizer, a polymer compound having a specific molecular weight range as a charge control agent, and optimizing the content of each component in a specific range, when preparing toner by suspension polymerization, and completed the invention.

Specifically, common suspension polymerization process of polymerized toner may be applied to the present invention, except that calcium phosphate is used as a dispersion stabilizer when preparing an aqueous dispersion, and polymer having weight average molecular weight of about 10,000 to 20,000 is used as a charge control agent.

In general, suspension polymerization obtains toner having desired particle diameter by preparing a monomer mixture by dissolving or dispersing pigment, a charge control agent, wax, etc. in a monomer for a binder resin, dispersing the mixture in an aqueous dispersion to form fine droplets of monomer mixture, and suspension-polymerizing at an elevated temperature.

The present invention, during the suspension polymerization, uses calcium phosphate as a dispersion stabilizer for an aqueous dispersion to secure excellent dispersion stability, uses polymer having a specific molecular weight range as a charge control agent, so as to provide excellent compatibility with binder resin and secure suspension polymerization stability, thereby effectively controlling particle diameter of toner particles to prepare polymerized toner having narrow particle size distribution.

For this, the present invention provides a process for preparing toner comprising: forming an aqueous dispersion medium comprising calcium phosphate; forming a monomer mixture of a polymer charge control agent having weight average molecular weight of about 10,000 to 20,000, pigment, and a monomer for a binder resin; dispersing the monomer mixture into the aqueous dispersion medium in the form of droplets; and, suspension-polymerizing the monomer mixture dispersed in the form of droplets, wherein about 2 to 6 parts by weight of the calcium phosphate and about 0.6 to 10 parts by weight of the charge control agent are used, based on 100 parts by weight of the monomer mixture.

According to the process, a monomer mixture of monomers for a binder resin, a charge control agent and pigment is added to an aqueous dispersion comprising calcium phosphate so as to disperse it in the form of fine droplets, and then, the dispersion is suspension-polymerized. Thereby, the monomer mixture in the form of fine droplets is polymerized to form toner particles, i.e., to prepare polymerized toner of the present invention.

Specifically, as results of experiments, it was found that uniform particle size and narrow particle size distribution, high transcription efficiency, and uniform image can be obtained by using about 2 to 6 parts by weight of calcium phosphate as a dispersion stabilizer, and about 0.6 to 10 parts by weight of polymer having weight average molecular weight of about 10,000 to 20,000 as a charge control agent, based on 100 parts by weight of the monomer mixture.

The process for preparing toner is explained in detail.

According to the process, first, an aqueous dispersion comprising calcium phosphate is formed, and a monomer mixture of a polymer charge control agent having weight average molecular weight of about 10,000 to 20,000, pigment and a monomer for a binder resin is formed. Then, the monomer mixture is added into the aqueous dispersion to disperse it in the form of droplets. At this time, the aqueous dispersion for dispersing the monomer mixture may be prepared by dissolving a dispersion stabilizer in water. The present invention uses calcium phosphate as the dispersion stabilizer so that the monomer mixture may be maintained in a stable dispersion state for the aqueous medium.

As explained above, calcium phosphate used in the present invention functions as a dispersion stabilizer for a polymerizable monomer composition in the aqueous dispersion.

A dispersion stabilizer which is usable in the present invention may be an inorganic dispersion stabilizer such as calcium phosphate, hydroxyl apatite, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, etc. Also, the dispersion stabilizer may be an organic dispersion stabilizer such as polyvinyl alcohol, gelatin, methyl cellulose, methyl hydroxy propyl cellulose, ethyl cellulose, carboxylmethyl cellulose, and a sodium salt thereof, polyacrylic acid and a salt thereof, and starch, etc.

In toner preparation process by suspension polymerization, the dispersion stabilizer may be used in the form of dispersion in an aqueous system. It seems that the dispersion stabilizer is uniformly dispersed in an aqueous medium to prevent aggregation of particles of the polymerizable monomer composition existing as droplets and to stabilize the droplets by absorption onto the surface of the droplets. After completion of polymerization of the polymerizable monomer in the droplets, the dispersion stabilizer may be solubilized by acid or alkali treatment, warm water wash, etc. and separated from the toner particles.

However, many of the compounds that can be used as a dispersion stabilizer may not be completely removed from the surface of toner particles, according to its physical properties such as solubility, molecular weight, viscosity, etc. Also, depending on the composition of toner particles, a process such as strong alkali treatment, warm water wash, etc. may cause decomposition, dissolution, or heat denaturation of a coloring agent and a charge control agent, so that surface property, friction chargeability, etc. of toner particles may be damaged and development property of toner may be significantly deteriorated. Meanwhile, since some kinds of the inorganic dispersion stabilizer may cause a strong aggregation, a viscosity during polymerization of droplets may be increased or decreased and droplet stability may be deteriorated to cause unstable phenomenon such as droplet aggregation, etc. Thus, it is not easy to select the dispersion stabilizer.

Since the present invention prevents the unstable phenomenon by using calcium phosphate as an aqueous dispersion stabilizer and achieves excellent dispersion stability when preparing polymerized toner. Also, it may be easily removed from the surface of toner particles only by acid treatment and/or water wash, and then decomposition and dissolution of a coloring agent, a charge control agent, etc. is not caused, and heat denaturation needs not to be considered.

The calcium phosphate herein refers to at least one kind selected from calcium phosphate, calcium hydrogen phosphate, monocalcium phosphate, hydroxy apatite, and a mixture thereof. Considering size of crystal, particle diameter of crystal aggregate, acid solubility, etc., calcium phosphate is preferable, and hydroxyl apatite is most preferable.

According to preferred embodiment, calcium phosphate may be prepared in an aqueous medium using an aqueous phosphate solution and an aqueous solution of calcium salt. In case calcium phosphate prepared in an aqueous medium is used, aggregate may not be generated and uniform fine particle crystals may be obtained. Thus, more preferable effect of the dispersion stabilizer may be obtained and a stabilized suspension may be obtained. Particularly, in case powder calcium phosphate is used as it is, it may easily become a strong aggregate, so that particle diameter of the aggregate is non-uniform and it may be difficult to be dispersed in an aqueous medium. Accordingly, it is more preferable to use calcium phosphate prepared in an aqueous medium.

Also, in case calcium phosphate prepared in an aqueous medium is used, a sodium phosphate aqueous solution is preferable as the aqueous phosphate solution and a calcium chloride aqueous solution is preferable as the aqueous solution of calcium salt. The sodium phosphate aqueous solution may have pH of about 4 to 7, preferably about 4.2 to 6.5, more preferably about 4.5 to 5.5. Particularly, in order to obtain spherical toner, it is preferable to control the pH of the aqueous solution obtained by mixing the aqueous phosphate solution and the aqueous solution of calcium salt in the range of about 4.5 to 5.5

The process may further comprise dropping acid such as nitric acid, sulfuric acid, etc. to the aqueous phosphate solution and adding the aqueous solution of calcium salt thereto, so as to control pH of the aqueous dispersion in the range of about 4 to 7, preferably 4.2 to 6.5, more preferably about 4.5 to 5.5.

The calcium phosphate may be used in an amount of about 2 to 6 parts by weight, preferably about 2.5 to 5 parts by weight, more preferably about 2.5 to 4 parts by weight, based on 100 parts by weight of a monomer for a binder resin. Specifically, the calcium phosphate is preferably used in an amount of about 2 parts by weight or more so as to stably maintain particles during polymerization. The calcium phosphate is preferably used in an amount of about 6 parts by weight or less so as not to produce small particles during homogenization of the monomer mixture.

If polymerized toner is prepared by using the calcium phosphate aqueous dispersion medium, toner particles may be produced in the state of absorption of calcium phosphate on the surface thereof. Thus, pH of the aqueous dispersion containing the prepared toner particles, i.e., a resultant solution of the suspension polymerization may be controlled to about 2 or less, preferably about 1.7 or less, more preferably about 1.5 or less, and then a washing process may be performed to completely dissolve calcium phosphate and recover toner particles. This washing process may be repeated, and then drying may be conducted to obtain final toner particles.

As explained above, if calcium phosphate is used as an aqueous dispersant, pH of the aqueous dispersion medium may be easily controlled to neutral or acid and the charge control agent with minus charge may be easily moved to the surface of toner particles by electrostatic attraction thereof. If the amount of the calcium phosphate is less than about 2 parts by weight, based on 100 parts by weight of monomer mixture, it is not sufficient for stabilizing droplets of the monomer mixture, and thus particle fusion may be generated during polymerization. Also, if the amount of the calcium phosphate exceeds about 6 parts by weight, small particles may be generated during homogenization of the monomer mixture.

The calcium phosphate is rapidly solubilized at an acid region of lower pH of about 1.5 to 2.5 and completely solubilized at a strong acid region of pH 1.5 or less. Therefore, in order to completely remove dispersion stabilizer particles from toner particles, acid treatment may be conducted at pH of about 2.0 or less, preferably about 1.7 or less, more preferably about 1.5 or less. The acid treatment, differently from alkali treatment, does not cause decomposition, dissolution and denaturation of other components such as a coloring agent, a charge control agent, etc., and does not affect properties of toner, and thus preferable.

Also, the present invention uses polymer having weight average molecular weight of about 10,000 to 20,000 as a charge control agent, simultaneously with the aqueous dispersion comprising calcium phosphate.

In general, a cationic charge control agent, an anionic charge control agent, and a mixture thereof may be used as a charge control agent. The cationic charge control agent may include nigrosine type electron acceptor dye, a metal salt of high aliphatic substance, alkoxy amine, chelate, a quaternary ammonium salt, alkylamide, fluorine-containing activator, a metal salt of naphthalenic acid, etc. The anionic charge control agent may include an electron acceptor organic complex, chlorinated paraffin, chlorinated polyester, polyester containing excess acid, sulfonyl amine of copper phthalocyanine, and polymer having sulfonic acid group, etc.

However, if a chelate compound such as a metal salt is used as a charge control agent, stability is low and compatibility with binder resin is significantly deteriorated. Even though a polymer charge control agent is used, pigment may be concentrated on the surface of toner during polymerization due to surface-activeness of the pigment, so as to deteriorate chargeability of toner. Also, in this case, the charge control agent may be absorbed on the surface of pigment due to large surface area of the pigment, so that the amount of charge control agent involved in charge control may be insufficient and chargeability and charge stability of toner may be deteriorated.

Therefore, the present invention uses polymer having average molecular weight of about 10,000 to 20,000, preferably about 12,000 to 19,000, more preferably about 14,000 to 18,000 as a charge control agent. Thereby, the present invention may remarkably improve compatibility with binder resin and excellent stability, simultaneously with solving surface absorption problem of the charge control agent which may deteriorate chargeability and charge stability.

Particularly, in terms of high compatibility with binder resin and effective secure of polymerization stability, and uniform particle size distribution, a polymer charge control agent having weight average molecular weight of about 10,000 or more may be preferably used. Also, in terms of maintenance of surface concentration for effective action as a charge control agent and maintenance of optimal viscosity of the monomer mixture, a polymer charge control agent having weight average molecular weight of about 20,000 or less may be preferably used The charge control agent functions for stabilizing particles during suspension polymerization together with the dispersion stabilizer, and if the molecular weight exceeds about 20,000, the charge control agent may not sufficiently move to the surface of particles to cause particle fusion during suspension polymerization, and if it is less than about 10,000, small particles are more likely to be generated during homogenization of the monomer mixture.

The charge control agent may be preferably styrene acrylic polymer comprising sulfonic acid group. In case a copolymer having sulfonic acid group is used as the charge control agent, deterioration of charge control property due to surface concentration and absorption of pigment may be effectively eliminated to eliminate the effect of charging disturbance by pigment, and due to the improved and uniform charge property, the prepared polymerized toner has narrow particle size distribution and high transcription efficiency, and can realized uniform image.

The charge control agent may be at least one kind of a polymer represented by the following Chemical Formula 1.

[Chemical Formula 1]

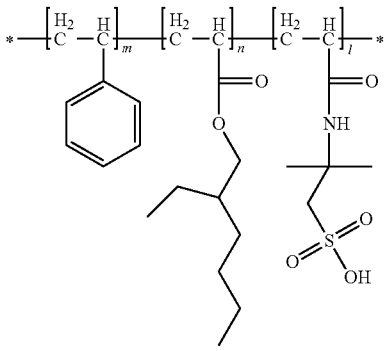

wherein, l, m, n are identical or different, respectively an integer of from 1 to 60, preferably 3 to 55, more preferably 5 to 50, and l:(m+n) is 3:97 to 15:85, preferably 5:95 to 13:87, more preferably 7:93 to 12:88. Particularly, l is an integer of 1 to 40, preferably 3 to 30, more preferably 5 to 20, and m, n are an integer of from 10 to 60, preferably 20 to 55, more preferably 30 to 50, respectively. The range of l:(m+n) may be expressed by the percentage (%) of l/(l+m+n). In Chemical Formula 1, the percentage (%) of l/(l+m+n) is 3% to 15%, preferably 5% to 13%, more preferably 7% to 12%.

For example, the charge control agent may be represented by the following Chemical Formula 2:

[Chemical Formula 2]

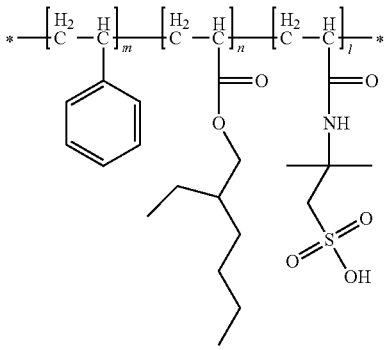

wherein, l, m, n are respectively 10, 40, 50, and l:(m+n) is 10:90.

Also, the charge control agent may be represented by the following Chemical Formula 3:

[Chemical Formula 3]

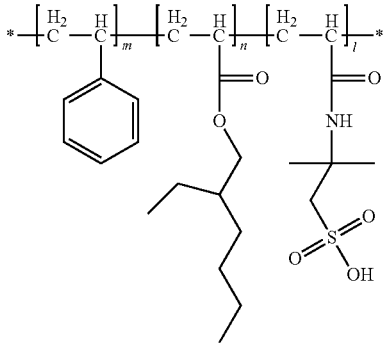

Wherein, l, m, n are respectively 7, 35, 35, and l:(m+n) is 7:70.

The charge control agent may have acid value of about 1 to 40 mg KOH/g, preferably about 2 to 38 mg KOH/g, more preferably about 3 to 35 mg KOH/g, and glass transition temperature of about 30° C. to 120° C., preferably about 32° C. to 118° C., more preferably about 35° C. to 115° C. If the acid value of the polymer charge control agent is less than about 1, the action as a charge control agent may not be smooth, and if it exceeds about 40, interfacial property of the monomer mixture may be affected to aggravate polymerization stability. And, if the glass transition temperature of the polymer charge control agent is less than about 30° C., friction-melting between toners may be generated at printing due to low glass transition temperature of the charge control agent to cause blocking. On the other hand, if it exceeds about 120° C., the surface of toner may be excessively hardened to aggravate coatability and adhesion.

The polymer charge control agent may be used in an amount of about 0.6 to 10 parts by weight, preferably about 1 to 8 parts by weight, more preferably about 1.5 to 5 parts by weight, based on 100 parts by weight of the monomer mixture for a binder resin. The charge control agent may be preferably used in an amount of about 0.6 parts by weight or more in terms of dispersion stability, and it may be preferably used in an amount of, about 10 parts by weight or less so as to inhibit generation of fine powders due to emulsion polymerization, etc.

As the monomer for a binder resin, any monomer usable for toner prepared by polymerization may be used, without specific limitation. The examples of the monomer may include a styrene based monomer, an acrylic monomer, a methacrylic monomer, a diene based monomer, and a mixture thereof. And, at least one of an acid olefin monomer or a basic olefin monomer may be optionally mixed with the monomer.

According to more preferred embodiment, the monomer may comprise (a) a styrene based monomer, and (b) at least one monomer selected from the group consisting of an acrylic monomer, a methacrylic monomer and a diene based monomer; the content of the (a) styrene based monomer may be about 30 to 95 parts by weight, preferably about 32 to 93 parts by weight, more preferably about 35 to 90 parts by weight, based on 100 parts by weight of total amounts of the monomers (a) and (b), and the content of the (b) at least one monomer selected from the group consisting of an acrylic monomer, a methacrylic monomer and a diene based monomer may be about 5 to 70 parts by weight, preferably about 7 to 68 parts by weight, more preferably about 10 to 65 parts by weight; and the monomer may optionally further comprise (c) at least one selected from the group consisting of an acid olefin monomer or a basic olefin monomer in an amount of about 30 parts by weight or less, or about 0.1 to 30 parts by weight, preferably about 28 parts by weight or less, or about 0.3 to 28 parts by weight, more preferably about 25 parts by weight or less, or about 0.5 to 25 parts by weight, based on 100 parts by weight of the total amounts of the monomers (a) and (b).

The aromatic vinyl monomer may include styrene, monochlorostyrene, methylstyrene, dimethylstyrene, etc., and it may be preferably used in an amount of about 30 to 95 parts by weight, more preferably about 40 to 90 parts by weight, most preferably about 50 to 80 parts by weight, based on the total amounts of the monomers.

The acrylic monomer may include methylacrylate, ethylacrylate, n-butylacrylate, isobutylacrylate, dodecyl acrylate, 2-ethylhexylacrylate, etc.; the methacrylic monomer may include methyl methacrylate, ethyl methacrylate, n-butyl methacrylate, isobutyl methacrylate, dodecyl methacrylate, 2-ethyl hexyl methacrylate, etc.; and, the diene monomer may include butadiene, isoprene, etc. The at least one of the acrylic monomer, a methacrylic monomer and a diene monomer may be used in an amount of about 5 to 70 parts by weight, preferably about 10 to 60 parts by weight, more preferably about 20 to 50 parts by weight, based on the total amounts of the monomers.

The acid olefin monomer may include α,β-ethylene unsaturated compounds having carboxylic group, etc., and the basic olefin monomer may include methacrylic esters of aliphatic alcohol having amine group or quaternary ammonium group, methacrylamides, vinyl amines, dially amines or an ammonium salt thereof, etc. In case at least one of the acid or basic olefin monomer is used, it may be preferably used in an amount of about 0.1 to 30 parts by weight, more preferably about 0.15 to 20 parts by weight, most preferably about 0.2 to 10 parts by weigh, based on the total amounts of the monomers.

And, optionally, at least one polar polymer selected from the group consisting of polyester polymer and styene acrylic polymer may be added in an amount of about 0.01 to 10 parts by weight, preferably about 0.05 to 9 parts by weight, more preferably about 0.1 to 8 parts by weight, based on 100 parts by weight of the monomers.

The process of the present invention forms the monomer mixture by including pigment together with the polymer charge control agent having weight average molecular weight of about 10,000 to 20,000 and the monomer for the binder resin.

As the pigment, any pigment used for polymerized toner may be used, and for examples, at least one selected from the group consisting of metal powder pigment, metal oxide pigment, carbon pigment, sulfide pigment, chrome salt pigment, ferrocyanide pigment, azo-type pigment, acid dye pigment, basic dye pigment, mordant dye pigment, phthalocynine pigment, quinacridone pigment, and dioxane pigment may be used. The pigment may be used in an amount of about 1 to 10 parts by weight, preferably about 1.5 to 9 parts by weight, more preferably about 2 to 8 parts by weight, based on 100 parts by weight of the monomer mixture.

And, the monomer mixture may further comprise at least one additive selected from the group consisting of wax, a reaction initiator, a crosslinking agent, a lubricant (for example, oleic acid, stearic acid, etc.), a molecular weight control agent, and a coupling agent.

The wax may include at least one selected from the group consisting of paraffin wax, microcrystalline wax, ceresin wax, carnauba wax, ester type wax, polyethylene type wax, and polypropylene type wax. The wax may be used in an amount of about 30 parts by weight or less, or 0.1 to 30 parts by weight, preferably about 25 parts by weight or less, or about 0.2 to 25 parts by weight, more preferably about 20 parts by weight or less, or about 0.3 to 20 parts by weight, based on 100 parts by weight of the monomer mixture.

As the reaction initiator, an oil-soluble initiator and a water-soluble initiator may be used. For examples, an azo-type initiator such as azobisisobutyronitrile, azobisvaleronitrile, etc.; organic peroxide such as benzoyl peroxide, lauroyl peroxide, etc.; a commonly used water-soluble initiator such as potassium persulfate, ammonium persulfate, etc. may be used. The reaction initiator may be used in an amount of about 5 parts by weight or less, or 0.01 to 5 parts by weight, preferably about 4 parts by weight or less, or about 0.05 to 4 parts by weight, more preferably about 2.0 parts by weight or less, or about 0.1 to 2.0 parts by weight, based on 100 parts by weight of the monomer mixture.

The crosslinking agent may include at least one selected from the group consisting of divinylbenzene, ethylene dimethacrylate, ethylene glycol dimethacrylate, diethylene gylcol diacrylate, 1,6-hexamethylene diacrylate, allyl methacrylate, 1,1,1-trimethylolpropane triacrylate, triallylamine and tetra allyl oxyethane, and it may be used in an amount of about 10 parts by weight or less, or 0.001 to 10 parts by weight, preferably about 9 parts by weight or less, or about 0.005 to 9 parts by weight, more preferably about 8 parts by weight or less, or about 0.01 to 8 parts by weight, based on 100 parts by weight of the monomer mixture.

The molecular weight control agent may include at least one selected from the group consisting of t-dodecyl mercaptan, n-dodecyl mercaptan, n-octyl mercaptan, carbon tetrachloride and carbon tetrabromide, and it may be used in an amount of about 8 parts by weight or less, or 0.001 to 8 parts by weight, preferably about 7 parts by weight or less, or about 0.005 to 7 parts by weight, more preferably about 6 parts by weight or less, or about 0.01 to 6 parts by weight, based on 100 parts by weight of the monomer mixture.

As the lubricant and coupling agent, any additives known to be usable for a monomer mixture for preparing polymerized toner may be used in an appropriate amount.

The present invention may optionally further comprise several additives in addition to a charge control agent, an pigment and a monomer, to form the monomer mixture with the above composition.

After adding the monomer mixture to the aqueous medium, the monomer mixture in the aqueous medium is uniformly dispersed in the form of fine droplets, and the monomer mixture in the form of fine droplets forms a finally prepared toner particles. At this time, for dispersion in the form of the fine droplets, a homogenizer may be applied to the monomer mixture and the aqueous dispersion to add shear stress and homogenize. For example, the mixed solution may be homogenized with a homogenizer at a speed of about 5,000 rpm to 20,000 rpm, preferably about 6,000 rpm to 18,500 rpm, more preferably about 8,000 rpm to 17,000 rpm, thereby dispersing the monomer mixture in the aqueous medium in the form of droplets.

And then, suspension polymerization of the monomer mixture dispersed in the form of droplets is progressed. The polymerization progresses while the polymerizable monomer, etc. is dispersed in the form of fine droplets, to form a specific polymer or copolymer. Thereby, toner particles comprising the polymer or copolymer as a main ingredient may be formed. The suspension polymerization may be conducted at a temperature of about 60 to 90° C., preferably about 65 to 85° C., more preferably about 70 to 80° C. for about 8 to 20 hours, preferably about 9 to 18 hours, more preferably about 10 to 15 hours, thereby forming polymerized toner having uniform particle size distribution.

Meanwhile, after forming the toner particles by the suspension polymerization, washing of the toner particles to remove calcium phosphate and drying of the toner particles may be further conducted, and as the result, polymerized toner according to another embodiment of the invention may be prepared.

The removing of calcium phosphate may be conducted by dropping water-soluble inorganic acid to the dispersion comprising produced toner particles so as to control pH to about 2 or less, preferably about 1.7 or less, more preferably about 1.5 or less, considering solubility of calcium phosphate according to pH, thereby dissolving the dispersion stabilizer in the aqueous solution to extricate it from the toner particles. After removing the dispersion stabilizer by this process, processes of removing water through a filter, adding excess of distilled water again to dilute, and removing water may be repeated several times.

And then, a toner cake may be put in a vacuum oven and vacuum dried at room temperature to prepare pressurized adhesive toner.

In addition, if necessary, separate external additives such as silica, etc. may be coated on the surface of toner, and the coating of the external additives may be conducted by adding the external additives to the toner particles using Henschel mixer, and agitating at high speed. As the silica, any silica known to be usable for polymerized toner may be used.

According to yet another preferred embodiment, polymerized toner may be prepared by a process comprising: mixing a sodium phosphate aqueous solution and a calcium phosphate aqueous solution to prepare an aqueous dispersion comprising precipitated calcium phosphate; dispersing a monomer mixture in the aqueous dispersion in the form of fine droplets through homogenization; polymerizing the monomer mixture dispersed in the form of droplets; washing and drying the polymerized toner core; and, coating the polymerized toner core with the external additives.

The process for preparing polymerized toner according to preferred embodiment is explained in detail.

(1) Preparation of Polymerized Toner

About 0.1 M of a sodium phosphate aqueous solution and about 1 M of a calcium chloride aqueous solution are mixed to prepare an aqueous dispersion comprising precipitated calcium phosphate, and a monomer mixture is added to the aqueous dispersion. After shear stress is added with a homogenizer to homogenize it, so as to disperse the monomer mixture in the form of fine droplets, and then polymerization is progressed to prepare a toner core.

As the monomer, an aromatic vinyl monomer, or an acrylic monomer, a methacrylic monomer, a diene type monomer or a mixture thereof may be used, and optionally, an acid or basic olefin monomer may be used.

(2) Removal of Calcium Phosphate and Drying

In order to extricate calcium phosphate in the solution comprising polymerized toner, hydrochloric acid is added to the polymerization reactant so as to control pH to about 2 or less, preferably about 1.7 or less, more preferably about 1.5 or less, thereby completely dissociating calcium phosphate in the aqueous medium. Subsequently, distilled water is added in an amount of about 2 times of total weight to dilute. Then, after shear stress is applied with a homogenizer, aseparation and washing processes are conducted with a filter press, a general centrifuge, continuous decanter type high speed centrifuge, etc. so as to completely separate calcium phosphate from the polymerization product. Finally, water is removed through filtering, and the toner cake is dried in a vacuum oven at room temperature to prepare a polymerized toner.

(3) Coating of External Additives

Silica is added to the polymerized toner core using Henschel mixer, and external additives are coated on the surface of the polymerized toner core while agitating at high speed of about 5,000 rpm for about 7 minutes.

The present invention also provides a polymerized toner prepared by the above process.

The polymerized toner may comprise about 0.8 to 30 parts by weight, preferably about 0.9 to 27 parts by weight, more preferably about 1.0 to 25 parts by weight of the polymer charge control agent having weight average molecular weight of about 10,000 to 20,000, preferably about 12,000 to 19,000, more preferably about 14,000 to 18,000, and about 2 to 28 parts by weight, preferably about 2.5 to 26 parts by weight, more preferably about 3 to 25 parts by weight of the pigment, based on 100 parts by weight of the binder monomer. If necessary, it may further comprise at least one selected from, based on 100 parts by weight of the monomers for the binder resin, about 35 parts by weight or less, or about 3 to 35 parts by weight, preferably about 32 parts by weight or less, or about 3.5 to 32 parts by weight, more preferably about 30 parts by weight or less, or about 4 to 30 parts by weight of wax; about 10 parts by weight or less, or about 0.03 to 10 parts by weight, preferably about 9 parts by weight or less, or about 0.04 to 9 parts by weight, more preferably about 8 parts by weight or less, or about 0.05 to 8 parts by weight of a reaction initiator; about 15 parts by weight or less, or about 0.003 to 15 parts by weight, preferably about 14 parts by weight or less, or about 0.004 to 14 parts by weight, more preferably about 13 parts by weight or less, or about 0.005 to 13 parts by weight of a crosslinking agent; or, about 12 parts by weight or less, or about 0.003 to 12 parts by weight, preferably about 11 parts by weight or less, or about 0.004 to 11 parts by weight, more preferably about 10 parts by weight or less, or about 0.005 to 10 parts by weight of a molecular weight control agent, etc.

Also, by using the prepared toner particles as toner core, silica, etc. may be coated on the surface of the toner.

As explained, using the process for preparing polymerized toner according to embodiment of the invention, toner having narrow particle size distribution can be effectively prepared by conducting suspension polymerization with each optimal content range of calcium phosphate and a polymer charge control agent having a specific molecular weight range.

Particularly, the polymerized toner prepared by the above process has narrow particle size distribution, and thus, toner particle size distribution can be easily controlled, and quality of the prepared toner can be easily reproduced. And, the polymerized toner can realize high transcription efficiency and uniform image, thus exerting excellent performance in electronic photo development, etc.

EXAMPLES

The present invention is further explained in more detail with reference to the following examples. These examples, however, should not be interpreted as limiting the scope of the present invention in any manner.

Example 1

Preparation of Polymerized Toner 686 parts by weight of 0.1 M sodium phosphate aqueous solution and 100 parts by weight of 1 M calcium chloride were mixed with 500 parts by weight of water to prepare an aqueous dispersion comprising precipitated calcium phosphate crystals. Then, the reaction temperature of the aqueous dispersion was elevated to about 7° C., and the dispersion was agitated for about 20 minutes, to finally prepare an aqueous dispersion comprising calcium phosphate. In the aqueous dispersion, the content of calcium phosphate was 3 parts by weight, based on 100 parts by weight of the following monomer mixture.

A monomer mixture was prepared by using a monomer, a pigment, and a charge control agent. 160 parts by weight of styrene, 36 parts by weight of n-butyl acrylate and 4 parts by weight of acrylic acid were introduced as the monomer. 4 parts by weight of ally methacrylate as a crosslinking agent, and 0.4 parts by weight of n-dodecyl mercaptan as a molecular weight control agent were introduced. Then, based on 100 parts by weight of the monomer mixture, 2.5 parts by weight of a styrene acrylic polymer charge control agent comprising sulfonic acid group (molecular weight: 16,500) was introduced and sufficiently dissolved. Thereafter, 10 parts by weight of pigment was agitated with a bead mill at about 2,000 rpm for about 2 hours and the bead was removed to finally prepare 225 parts by weight of the monomer mixture comprising a monomer, a pigment, and a charge control agent.

After the monomer mixture was elevated to about 70° C. by heating in a water bath, 20 parts by weight of paraffin wax was added and agitated for about 20 minutes. Then, the aqueous dispersion was homogenized using a homogenizer at a speed of 13,000 rpm, and the monomer mixture was dispersed into the aqueous dispersion in the form of droplets. Thereafter, it was reacted for 15 hours while agitating with a paddle type agitator at 200 rpm to prepare polymerized toner particles.

Meanwhile, as the styene acrylic polymer charge control agent comprising sulfonic acid group (molecular weight: 16,500), a compound of the following Chemical Formula 2 was used.

[Chemical Formula 2]

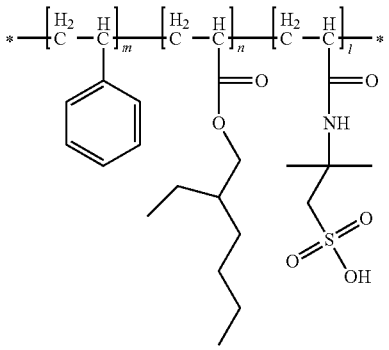

wherein, l, m, n are respectively 10, 40, 50, and l:(m+n) is 10:90.

Washing with Centrifuge

The aqueous dispersion comprising the polymerized toner as prepared above was to pH of less than 2 by adding hydrochloric acid therein, so as to dissolve calcium phosphate in the aqueous medium. Then, the aqueous dispersion was diluted by adding distilled water in an amount of about 2 times of total weight of the aqueous dispersion. After shear stress was applied with a homogenizer thereto, the mixture was centrifuged using a centrifuge (Beckman J2-21M, Rotor JA-14) at about 3,000 rpm for about 15 minutes. The above processes of diluting, applying shear stress with a homogenizer, and concentrating with a centrifuge were further repeated twice to remove calcium phosphate from the surface of the toner. Finally, water was removed through filtering and the prepared toner cake was dried in a vacuum oven at room temperature for about 48 hours to prepare polymerized toner core. The prepared polymerized toner core has a volume average particle diameter of 7 μm, and the ratio of volume average particle diameter and number average particle diameter is 1.26.

Coating of External Additives

Based on 100 parts by weight of the polymerized toner core, 2 parts by weight of silica was added using Henschel mixer, and the mixture was agitated at a high speed of 5,000 rpm for about 7 minutes to coat external additive on the surface of the polymerized toner core.

Example 2

Polymerized toner was prepared by substantially the same process as Example 1, except that a styrene-acrylic polymer charge control agent having weight average molecular weight of 12,000 was used.

As the styrene-acrylic polymer charge control agent comprising sulfonic acid (molecular weight: 12,000), a compound of the following Chemical Formula 3 was used.

[Chemical Formula 3]

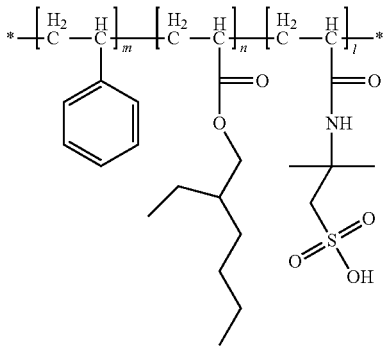

Wherein, l, m, n are respectively 7, 35, 35, and l: (m+n) is 7:70.

Example 3

Polymerized toner was prepared by substantially the same process as Example 1, except that the content of calcium phosphate was adjusted to 4 parts by weight, based on 100 parts by weight of the monomer mixture.

Example 4

Polymerized toner was prepared by substantially the same process as Example 1, except that the content of the styrene acrylic polymer charge control agent comprising sulfonic acid group was 1.5 parts by weight, based on 100 parts by weight of the monomer mixture.

Comparative Example 1

Polymerized toner was prepared by substantially the same process as Example 1, except that the content of the charge control agent was 0.5 parts by weight, based on 100 parts by weight of the monomer mixture.

Comparative Example 2

Polymerized toner was prepared by substantially the same process as Example 1, except that weight average molecular weight of the charge control agent was 5,000.

Comparative Example 3

Polymerized toner was prepared by substantially the same process as Example 1, except that the content of calcium phosphate was adjusted to 1 part by weight, based on 100 parts by weight of the monomer mixture.

Comparative Example 4

Polymerized toner was prepared by substantially the same process as Example 1, except that the content of the charge control agent was 12 parts by weight, based on 100 parts by weight of the monomer mixture.

Comparative Example 5

Polymerized toner was prepared by substantially the same process as Example 1, except that weight average molecular weight of the charge control agent was 22,000.

Comparative Example 6

Polymerized toner was prepared by substantially the same process as Example 1, except that the content of calcium phosphate was adjusted to 7 parts by weight, based on 100 parts by weight of the monomer mixture.

Comparative Example 7

Polymerized toner was prepared by substantially the same process as Example 1, except that a metal-containing salicylic acid type compound/aluminum di(t-butyl)salicylate was used as a charge control agent instead of the styrene acrylic polymer charge control agent comprising sulfonic acid group.

Comparative Example 8

Polymerized toner was prepared by substantially the same process as Example 1, except that PVA was used as a dispersion stabilizer instead of the calcium phosphate.

Comparative Example 9

Polymerized toner was prepared by substantially the same process as Example 1, except that colloidal silica was used as a dispersion stabilizer instead of the calcium phosphate.

Comparative Example 10

Polymerized toner was prepared by substantially the same process as Example 1, except that a colloidal dispersion of magnesium hydroxide obtained by mixing a magnesium chloride aqueous solution and sodium hydroxide aqueous solution was used as a dispersion stabilizer instead of the calcium phosphate.

Experimental Example

For the polymerized tones prepared according to Examples 1~4 and Comparative Examples 1~10, physical properties were measured as follow.

Transcription Efficiency of Toner

A supply part of a laser printer (HP4600, manufacturer: Hewlett Packard) cartridge was filled with surface-treated toner, and then, the weight of the total supply part was measured, and rectangle of 19 cm×1.5 cm was respectively printed in 1,000 sheets of A4 papers, and then, the weight of the supply part was measured again to calculate toner consumption by the following Equation Formula 1.

$$\text{Consumption}(g)=\text{weight before 1,000 sheets printing}-\text{weight after 1,000 sheets printing} \quad \text{[Equation Formula 1]}$$

Further, the weight of a drum part that can be separated from the supply part was measured before and after printing, and the amount of wasted toner failing to be transcribed in the paper was calculated by the following Equation Formula 2.

$$\text{Wasted toner amount}(g)=\text{weight of drum part after 1,000 sheets printing}-\text{weight of drum part before 1,000 sheets printing} \quad \text{[Equation Formula 2]}$$

After calculating the consumed and wasted toner amount, transcription efficiency was calculated by the following Equation Formula 3.

$$\text{Transcription efficiency}(\%)=\{(\text{consumption}-\text{wasted toner amount})/\text{consumption}\}*100 \quad \text{[Equation Formula 3]}$$

Image Uniformity

After front side printing in A4 sized papers with a laser printer (HP2600, manufacturer: Hewlett Packard), image concentrations were measured at 4 edges and 1 center of the printing paper using image densitometer (RD918, Macbath). Then, it was judged that image is uniform if difference between the measurement values is less than 0.05, image uniformity is normal if the difference is less than 0.1, and image is non-uniform if the difference is 0.1 or more.

The measurement results of average particle diameter, standard deviation, transcription efficiency, image uniformity of the polymerized toners prepared according to Examples 1~4 (Ex. 1~4) and Comparative Examples 1~10 (Corn. Ex 1~10) are shown in the following Table 1.

TABLE 1

| | Charge control agent | | Dispersion stabilizer | | Polymerized toner | | | |
|---|---|---|---|---|---|---|---|---|
| | Molecular weight | content (parts by weight) | ingredient | content (parts by weight) | Average particle diameter (μm) | Standard deviation | Transcription efficiency (%) | Image uniformity |
| Ex. 1 | 16,500 | 2.5 | Calcium phosphate | 3 | 7.5 | 1.27 | 95% | uniform |

TABLE 1-continued

| | Charge control agent | | Dispersion stabilizer | | Polymerized toner | | | |
|---|---|---|---|---|---|---|---|---|
| | Molecular weight | content (parts by weight) | ingredient | content (parts by weight) | Average particle diameter (μm) | Standard deviation | Transcription efficiency (%) | Image uniformity |
| Ex. 2 | 12,000 | 2.5 | Calcium phosphate | 3 | 7.3 | 1.27 | 96% | uniform |
| Ex. 3 | 16,500 | 2.5 | Calcium phosphate | 4 | 7.3 | 1.27 | 95% | uniform |
| Ex. 4 | 16,500 | 1.5 | Calcium phosphate | 3 | 7.5 | 1.27 | 95% | uniform |
| Com. Ex. 1 | 16,500 | 0.5 | Calcium phosphate | 3 | 7.5 | 1.27 | 95% | Non-uniform |
| Com. Ex. 2 | 5,000 | 2.5 | Calcium phosphate | 3 | 7.1 | 1.35 | 80% | Non-uniform |
| Com. Ex. 3 | 16,500 | 2.5 | Calcium phosphate | 1 | 10.5 | 1.35 | 70% | Non-uniform |
| Com. Ex. 4 | 16,500 | 12 | Calcium phosphate | 3 | 7.0 | 1.45 | 60% | Non-uniform |
| Com. Ex. 5 | 22,000 | 2.5 | Calcium phosphate | 3 | 9.0 | 1.33 | 70% | Non-uniform |
| Com. Ex. 6 | 16,500 | 2.5 | Calcium phosphate | 7 | 7.5 | 1.35 | 80% | Non-uniform |
| Com. Ex. 7 | — | 2.5 | Calcium phosphate | 3 | 7.5 | 1.3 | 70% | Non-uniform |
| Com. Ex. 8 | 16,500 | 2.5 | PVA | 3 | 7.0 | 1.45 | 60% | Non-uniform |
| Com. Ex. 9 | 16,500 | 2.5 | Colloidal silica | 3 | 6.8 | 1.40 | 70% | Non-uniform |
| Com. Ex. 10 | 16,500 | 2.5 | Magnesium hydroxide | 3 | 7.5 | 1.4 | 80% | Non-uniform |

As shown in the Table 1, the polymerized toners of Examples 1~4 using appropriate amounts of calcium phosphate as an aqueous dispersion stabilizer and a polymer charge control agent comprising sulfonic acid group with an appropriate molecular weight according to the present invention have excellent physical properties of particle size distribution, transcription efficiency and image uniformity, compared to Comparative Examples 1~7 wherein contents, kinds of charge control agent or molecular weight ranges depart from the scope of the invention.

It can be also seen that the polymerized toners of Examples 1~4 have excellent physical properties of particle size distribution, transcription efficiency and image uniformity, compared to Comparative Examples 8~10 using other dispersion stabilizers instead of calcium phosphate.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed:

1. A process for preparing toner comprising:

forming an aqueous dispersion medium comprising calcium phosphate, forming a monomer mixture of a polymer charge control agent having a weight average molecular weight of 14,000 to 18,000, pigment, and a monomer for a binder resin, dispersing the monomer mixture into the aqueous dispersion medium in the form of droplets, and suspension-polymerizing the monomer mixture dispersed in the form of droplets, wherein 2.5 to 4 parts by weight of the calcium phosphate and 1.5 to 5 parts by weight of the charge control agent are used, based on 100 parts by weight of the monomer mixture; and wherein the charge control agent is at least one kind of a polymer represented by the following Chemical Formula 1:

[Chemical Formula 1]

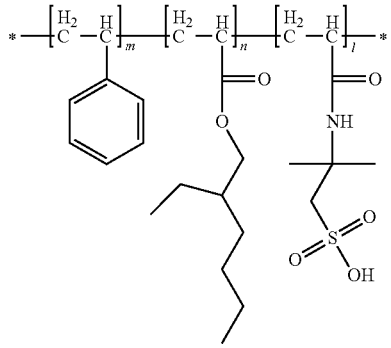

wherein l, m, n are identical or different, respectively an integer of from 1 to 60, and l:(m+n) is 3:97 to 15:85.

2. The process according to claim 1, wherein the calcium phosphate is prepared by mixing an aqueous phosphate solution and an aqueous solution of calcium salt.

3. The process according to claim 2, further comprising dropping water-soluble inorganic acid to the aqueous phosphate solution and adding the aqueous solution of calcium salt thereto so as to control pH of the aqueous dispersion medium in the range of 4 to 7.

4. The process according to claim 1, wherein the charge control agent is a styrene-acrylic polymer comprising sulfonic acid group.

5. The process according to claim 1, wherein the dispersing of the monomer mixture into the aqueous dispersion medium in the form of droplets comprises mixing the monomer mixture and the aqueous dispersion medium, and homogenizing the mixture with a homogenizer at a speed of 5,000 rpm to 20,000 rpm.

6. The process according to claim 1, further comprising washing toner particles prepared from the suspension polymerization so as to remove calcium phosphate, and drying the toner particles.

7. The process according to claim 6, further comprising dropping water-soluble inorganic acid into a resultant solution of the suspension polymerization before conducting the washing so as to control pH of the solution to 2.0 or less.

8. The process according to claim 1, wherein the monomer for a binder resin is at least one selected from the group consisting of an aromatic vinyl based monomer, an acrylic monomer, a methacrylic monomer, and a diene based monomer.

9. The process according to claim 1, wherein the pigment is at least one selected from the group consisting of metal powder pigment, metal oxide pigment, carbon pigment, sulfide pigment, chrome salt pigment, ferrocyanide pigment, azotype pigment, acid dye pigment, basic dye pigment, mordant dye pigment, phthalocynine pigment, quinacridone pigment, and dioxane pigment.

10. The process according to claim 1, wherein the monomer mixture further comprises at least one additive selected from the group consisting of wax, a reaction initiator, a crosslinking agent, a lubricant, a molecular weight control agent, and a coupling agent.

11. The process according to claim 10, wherein the wax is at least one selected from the group consisting of paraffin wax, microcrystalline wax, ceresin wax, carnauba wax, ester type wax, polyethylene type wax and polypropylene type wax.

12. The process according to claim 10, wherein the reaction initiator is at least one selected from the group consisting of azobisisobutyronitrile, azobisvaleronitrile, benzoyl peroxide, lauroyl peroxide, potassium persulfate, and ammonium persulfate.

13. The process according to claim 10, wherein the crosslinking agent is at least one selected from the group consisting of divinylbenzene, ethylene dimethacrylate, ethylene glycol dimethacrylate, diethylene gylcol diacrylate, 1,6-hexamethylene diacrylate, allyl methacrylate, 1,1,1-trimethylolpropane triacrylate, triallylamine and tetra allyl oxyethane.

14. The process according to claim 10, wherein the molecular weight control agent is at least one selected from the group consisting of t-dodecyl mercaptan, n-dodecyl mercaptan, n-octyl mercaptan, carbon tetrachloride and carbon tetrabromide.

15. A polymerized toner prepared by the process according to claim 1.

16. The polymerized toner according to claim 15, wherein the toner comprises 2 to 28 parts by weight of the pigment, based on 100 parts by weight of the monomer for a binder resin.

17. The polymerized toner according to claim 15, further comprising 35 parts by weight or less of wax, 10 parts by weight or less of a reaction initiator, 15 parts by weight or less of a crosslinking agent, and 12 parts by weight of a molecular weight control agent, based on 100 parts by weight of the monomer for a binder resin.

* * * * *